US011098497B2

(12) United States Patent
Tang

(10) Patent No.: US 11,098,497 B2
(45) Date of Patent: Aug. 24, 2021

(54) VENTILATED TENT

(71) Applicant: CHANGZHOU XINYA OUTDOOR METAL PRODUCTS CO. LTD., Changzhou (CN)

(72) Inventor: Guoliang Tang, Changzhou (CN)

(73) Assignee: CHANGZHOU XINYA OUTDOOR METAL PRODUCTS CO. LTD., Changzhou (CN)

( * ) Notice: Subject to any disclaimer, the term of this patent is extended or adjusted under 35 U.S.C. 154(b) by 0 days.

(21) Appl. No.: 16/770,623

(22) PCT Filed: Jul. 2, 2018

(86) PCT No.: PCT/CN2018/093984
§ 371 (c)(1),
(2) Date: Jun. 8, 2020

(87) PCT Pub. No.: WO2020/000494
PCT Pub. Date: Jan. 2, 2020

(65) Prior Publication Data

US 2021/0172192 A1 Jun. 10, 2021

(30) Foreign Application Priority Data

Jun. 26, 2018 (CN) ..... 201820992146.2

(51) Int. Cl.
*E04H 15/16* (2006.01)
*E04H 15/62* (2006.01)
(Continued)

(52) U.S. Cl.
CPC ..... *E04H 15/16* (2013.01); *E04H 15/34* (2013.01); *E04H 15/62* (2013.01); *E04H 15/64* (2013.01)

(58) Field of Classification Search
CPC ..... E04H 15/16; E04H 15/34; E04H 15/62; E04H 15/64
See application file for complete search history.

(56) References Cited

U.S. PATENT DOCUMENTS 39,416 A * 8/1863 Moakley ..... E04H 15/16 135/94
1,249,883 A * 12/1917 Baldwin ..... E04H 15/16 135/94

(Continued)

FOREIGN PATENT DOCUMENTS

EP 1092824 A2 * 4/2001
GB 2421961 A * 7/2006
WO WO-2004059106 A1 * 7/2004

*Primary Examiner* — Noah Chandler Hawk
(74) *Attorney, Agent, or Firm* — Bayramoglu Law Offices LLC

(57) ABSTRACT

A ventilated tent includes a tent cloth, a tent frame, a cloth rope and a buttonhole; the tent cloth is set on the tent frame fixedly connected with the tent frame; the tent cloth includes a top cloth, a front cloth, a back cloth, a left side cloth and a right side cloth; left and right ends of the top cloth cover top of the left side cloth and the right side cloth; the buttonhole is fixed at an edge of the tent cloth, the cloth rope connects the top end of the left side cloth and the top end of the right side cloth through the buttonhole, and a ventilation gap is formed when top end of the left side cloth and right side cloth go away from left end and tight end of the top cloth by tightening and relaxing the cloth rope.

10 Claims, 7 Drawing Sheets

(51) Int. Cl.
*E04H 15/34* (2006.01)
*E04H 15/64* (2006.01)

(56) References Cited

U.S. PATENT DOCUMENTS

| | | | | |
|---|---|---|---|---|
| 3,896,830 | A * | 7/1975 | Sharick | E04H 15/16 135/93 |
| 6,662,816 | B1 * | 12/2003 | Cunningham | E04H 15/16 135/93 |
| 2004/0035454 | A1 * | 2/2004 | Tseng | E04H 15/16 135/121 |
| 2013/0118095 | A1 * | 5/2013 | Hotes | E04H 15/16 52/86 |

* cited by examiner

VENTILATED TENT

CROSS REFERENCE TO THE RELATED APPLICATIONS

This application is the national phase entry of International Application No. PCT/CN2018/093984, filed on Jul. 2, 2018, which is based upon and claims priority to Chinese Patent Application No. 201820992146.2, filed on Jun. 26, 2018, the entire contents of which are incorporated herein by reference.

TECHNICAL FIELD

The invention refers to tent, particularly, refers to ventilated tent.

BACKGROUND

Tent is supported on the ground to shelter from wind, rain, snow, and sunlight, and is used for temporary residence, stacking storage items, tools, etc. Tent is most made of canvas or PE, and could be removed and transferred at any time together with supporting parts. Tent is carried in parts and is assembled only when it arrives on site, so various parts and tools are required.

The tent may be used in bad weather, and many tents would be swayed or be removed away under pressure of wind when they are used in windy weather, so ventilation should be taken into consideration when designing the tent.

For example, Chinese patent application CN106639628A provides a multilayered tent. The multilayered tent comprises at least three supporting legs, a first main mandril, a second main mandril, a center supporting rod, and top clothes; the top clothes is composed with at least two layers; and each of the top clothes includes a first top cloth at the upper part and a second top cloth at the lower part; inner end of the first main mandril is moveably connected with a center top cap, and outer end of the first main mandril is moveably connected with inner end of the second main mandril; outer end of the second main mandril is moveably connected with the supporting leg, and the center supporting rod is moveably connected with the first main mandril; inner end of the center supporting rod is moveably connected with a center bottom cap, and outer end of the center supporting rod is extended to the outside of the joint of the center supporting rod and the first main mandril; the first top cloth is covered on the center top cap, and outer side of the first top cloth is connected with the outer end of the center supporting rod; inner side of the second top cloth is fixed on the first main mandril or the second main mandril, and an air permeable gap is arranged between the inner side of the second top cloth and the outer side of the first top cloth. Technological solution in the patent is: "an air permeable gap is arranged between the inner side of the second top cloth and the outer side of the first top cloth", and it is realized by the following: supporting the top clothes and controlling the air permeable gap between the inner side of the second top cloth and the outer side of the first top cloth by the center supporting rod, the first main mandril and the second main mandril. This solution needs to be controlled by multiple support rods, and the structure is relatively complicated.

Another example, Chinese patent CN206591908U discloses a tent that can keep ventilation including a tent body constituted by tent cloth and tent frame supporting the tent cloth, the appearance of supported tent body is pyramid. A door passing in and out and window are provided on the tent body's side surface, vent is set on top of at least one side surface, windshield cap is set on top of tent body. The windshield cap includes cap body and frame at edge of the cap body being capable of making the cap body keep open. Lower edge of the vent is higher than lower edge of the cap body, and gap for air ventilation is set between the cap body and the tent body. Vent is provided in the patent to realize ventilation, although the vent could realize ventilation, however, water is easy to enter into the tent.

SUMMARY

In order to overcome the fault of complicated structure and water entering at the vent, the invention provides a ventilated tent.

The invention solves the fault by the following technical solution: a ventilated tent including tent cloths and tent frame, wherein, also including cloth rope and buttonhole; the tent cloths is set on the tent frame fixedly connected with the tent frame; the tent cloths includes top cloth, front cloth, back cloth, left side cloth and right side cloth, left and right ends of the top cloth cover top of the left side cloth and the right side cloth; the buttonhole is fixed at edge of the tent cloths, the cloth rope connects top end of the left side cloth and the right side cloth through the buttonhole, and ventilation gap is formed when top end of the left side cloth and right side cloth go away from left end and tight end of the top cloth by tightening and relaxing the cloth rope.

Preferably, edge of each cloth of the top cloth, front cloth, back cloth, left side cloth and right side cloth is folded, and folded thickness is equal to or more than that of two tent cloths.

Preferably, the buttonhole is composed of circle ring and pressed ring, the cross section of the buttonhole is circular ring structure in H-shape, and the buttonhole is fixedly connected at folded portion of the tent cloths.

Preferably, the tent frame is composed of multiple supporting rods fixedly connected each other, and the supporting rod could be bended and extruded to be installed.

Preferably, the supporting rods are fixedly connected by bolts or in an insertion manner.

Preferably, when the supporting rods are fixedly connected by bolts, nut is in butterfly-shape, bolt is carriage bolt, and supporting rod is provided concave structure at bolts connection portion.

Preferably, when the supporting rods are fixedly connected in an insertion manner, cross section of insertion end of the supporting rod is in 8-shape.

Preferably, the tent also includes device for fixing the tent onto ground, the device for fixing the tent onto ground includes one mounting bar in Ω-shape and two spikes in T-shape, hollow part of the mounting bar in Ω-shape is mounted on the supporting rod near the ground in the frame, and the spikes in T-shape goes across the left and right ends of the mounting bar in Ω-shape to be inserted into the ground to install and fix the tent.

Preferably, the left and right ends of the top cloth are fixedly connected with the left side cloth and right side cloth respectively, back end of the top cloth is connected with the back cloth, and top end of the front cloth is glidingly glidingly connected with the frame.

Preferably, one window is set on the left side cloth and/or the right side cloth, and openable curtain is provided on the window.

Compared with the prior arts, the invention has following beneficial effects: in the invention, the cloth rope is used to connect the left side cloth and right cloth, when there is no wind, the cloth rope is released, when there is wind, the cloth rope is tightened to make top of the left and fight side cloth go near forming ventilation gap between the top cloth and left and fight side cloth. The tent has good ventilation effect, and its structure is simple and easy to be realized.

In the invention, left and right ends of the top cloth cover top of the left side cloth and the right side cloth, therefore, when the tent is used in rain and snow, water would slide to the left and right side cloth from the top cloth, finally water drops onto ground, which solve problem of water entering into the tent at the vent.

In the invention, front end of front cloth is glidingly connected with the frame, so that the front cloth could slide left and right easily, and it is convenient to enter in or out.

In the invention, supporting rod is provided with concave structure at connection portion with bolts, it is convenient to make the bolts enter into the concave slots, so that the bolts would not be convex preventing the tent cloths to be scratched by convex connection element.

In the invention, new nut in butterfly-shape is used, so that when the tent is installed, operator could tight the bolts by hand, and it is convenient.

Figure 1:
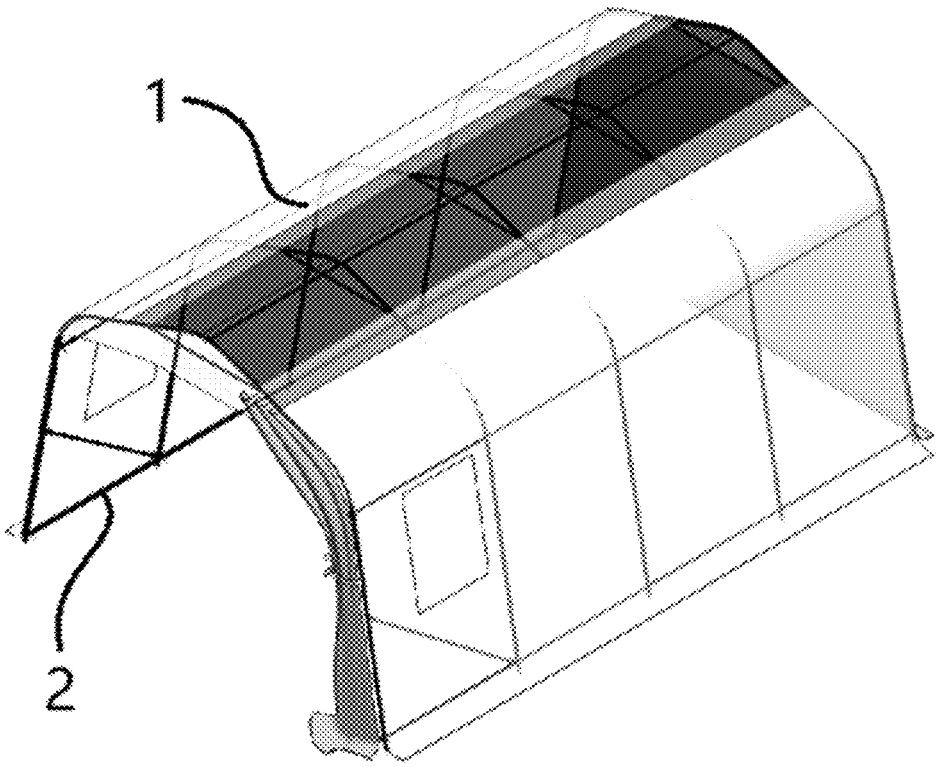
FIG. 1 is simple schematic diagram of structure of the tent in the invention.
Figure 2:
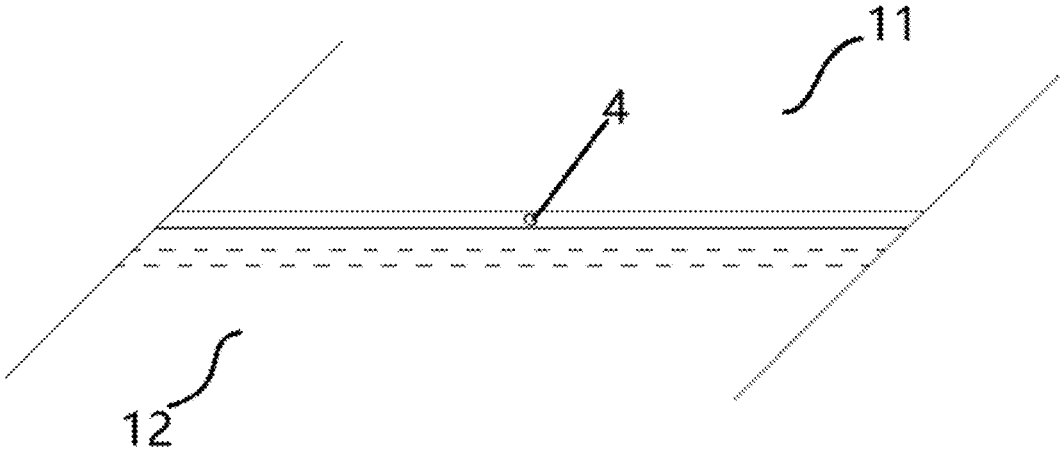
FIG. 2 is simple schematic diagram of structure of the tent when the vent is closed in the invention.
Figure 3:
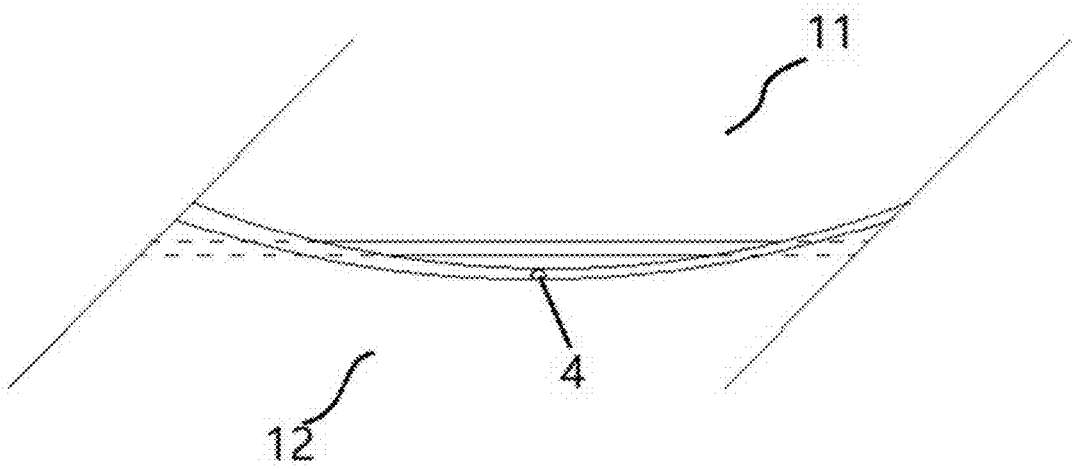
FIG. 3 is simple schematic diagram of structure of the tent when the vent is open in the invention.
Figure 4:
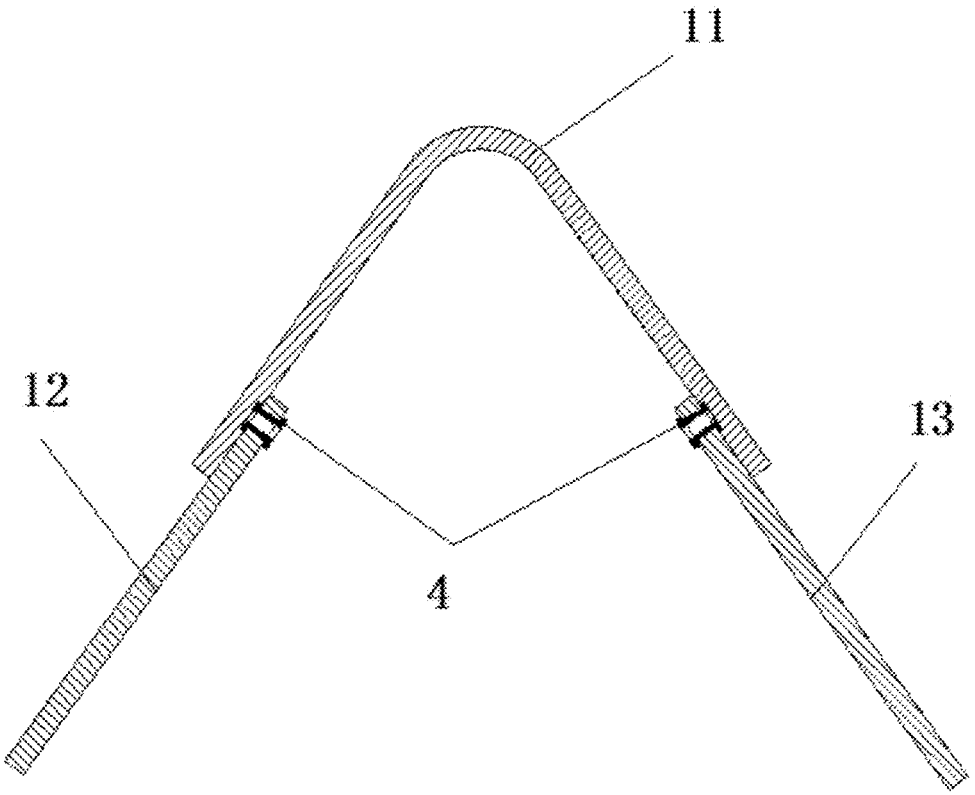
FIG. 4 is simple schematic diagram of section of the tent when the vent is closed in the invention.
Figure 5:
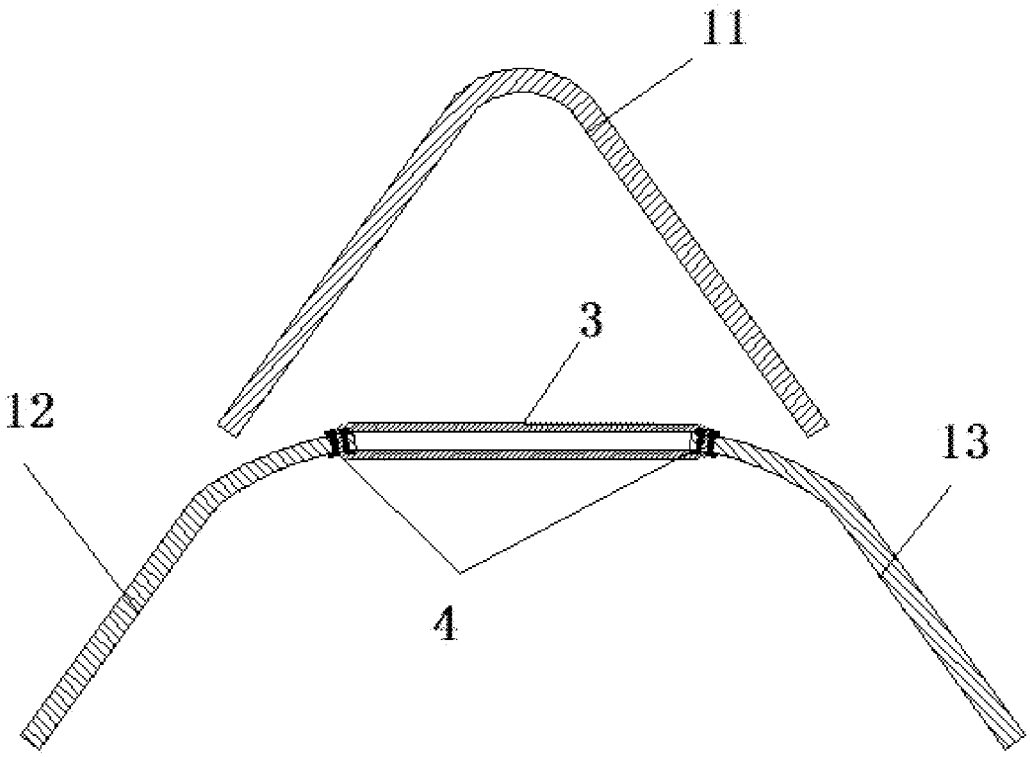
FIG. 5 is simple schematic diagram of section of the tent when the vent is open in the invention.
Figure 6:
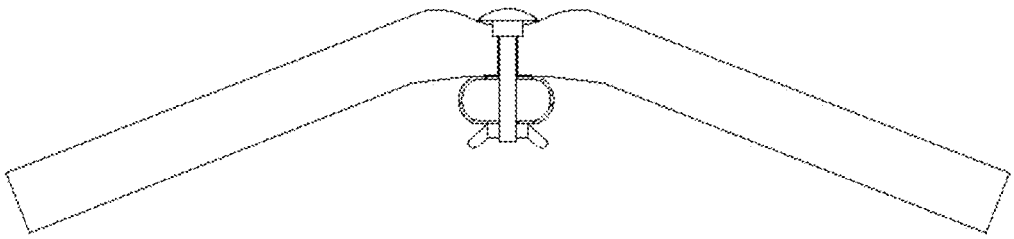
FIG. 6 is simple schematic diagram of structure of first connection type of the frame in the invention.
Figure 7:
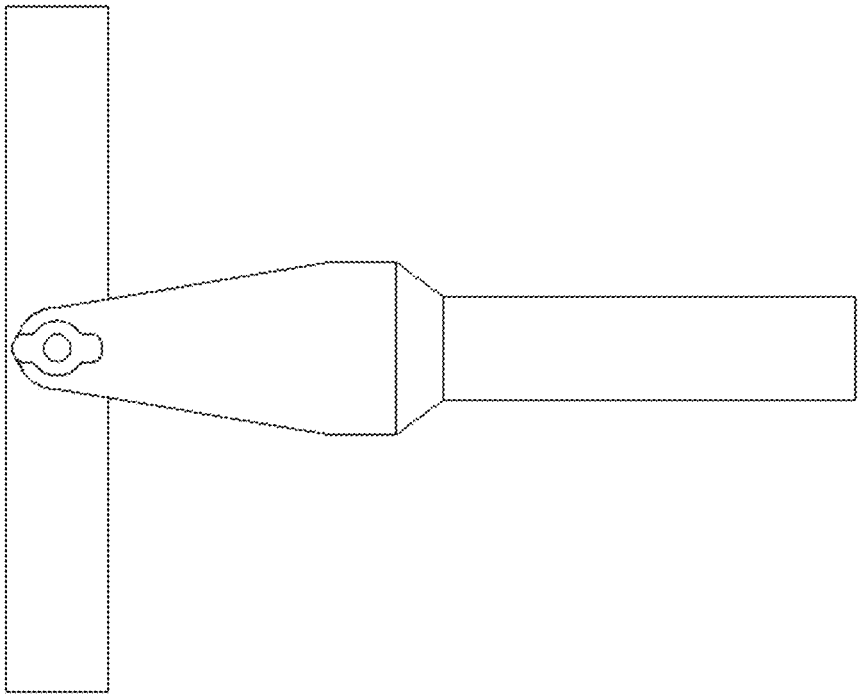
FIG. 7 is top view of structure of second connection type of the frame in the invention.
Figure 8:
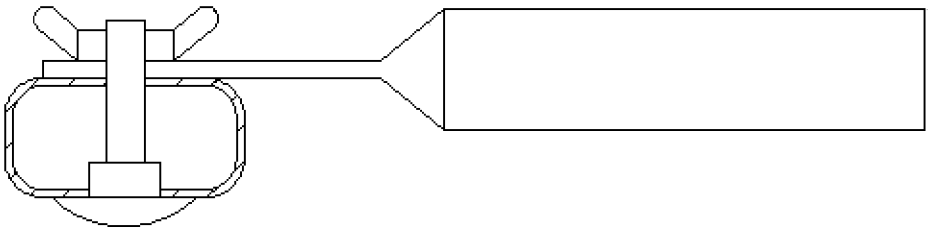
FIG. 8 is front view of structure of second connection type of the frame in the invention.

In the figures: 1 represents tent cloths, 2 represents frame, 3 represents cloth rope, 4 represents buttonhole, 11 represents top cloth, 12 represents left side cloth, 13 represents right side cloth.

DETAILED DESCRIPTION OF THE EMBODIMENTS

The invention will be described in detail with drawings and embodiments. It should be understood that the embodiments are just examples in the invention, and the invention should not be limited by the examples.

Shown as FIGS. 1-11, a ventilation tent is provided in the invention.

The invention discloses a ventilation tent, shown as FIGS. 1-5, ventilated tent including tent cloths 1 and tent frame 2, wherein, also including cloth rope 3 and buttonhole 4; the tent cloths 1 is sheathed on the tent frame 2 and fixedly connected with the tent frame 2; the tent cloths 1 includes top cloth 11, front cloth, back cloth, left side cloth 12 and right side cloth 13, left and right ends of the top cloth 11 cover top of the left side cloth 12 and the right side cloth 13; further preferred, width of covered portion is 100-300 mm, with the width, good ventilation is ensured, and water could be prevented from entering into the tent. The buttonhole 4 is fixed at the edge of the tent cloths, the cloth rope 3 connects top end of the left side cloth 12 and right cloth 13 through the buttonhole 4, and ventilation gap is formed when top end of the left side cloth 12 and right side cloth 13 go away from left end and tight end of the top cloth 11 by tightening and relaxing the cloth rope. Further, length and/or amount of the left side cloth 12 and right side cloth could be increased or decreased to realize adjusting area of the tent, so that the tent could satisfy different place and requirements.

As preferred embodiment, edge of each cloth of the top cloth 11, front cloth, back cloth, left side cloth 12 and right side cloth 13 are folded, and folded thickness is equal to or more than that of two tent cloths. The cloth at the edge part will be folded and sewn, and thickness of the folded edge is thickness of at least two layers, which would enhance firmness of the edge of the tent cloth 1 and makes its connection more stable.

Figure 11:
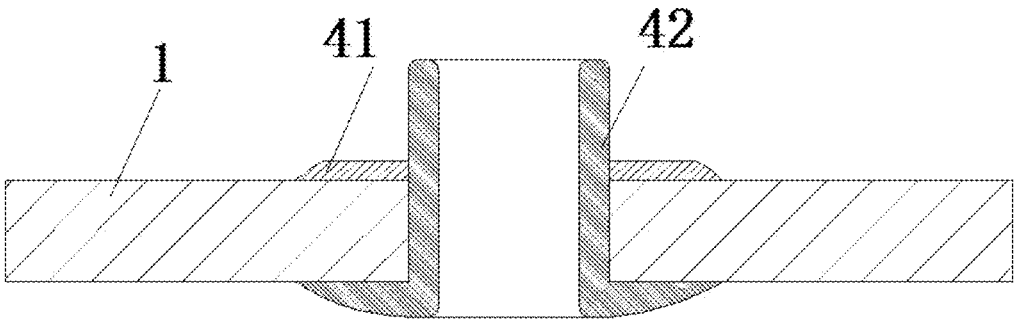
FIG. 11 is simple schematic diagram of section of connection between the buttonhole and the tent cloths before it is fixed in the invention.
Figure 12:
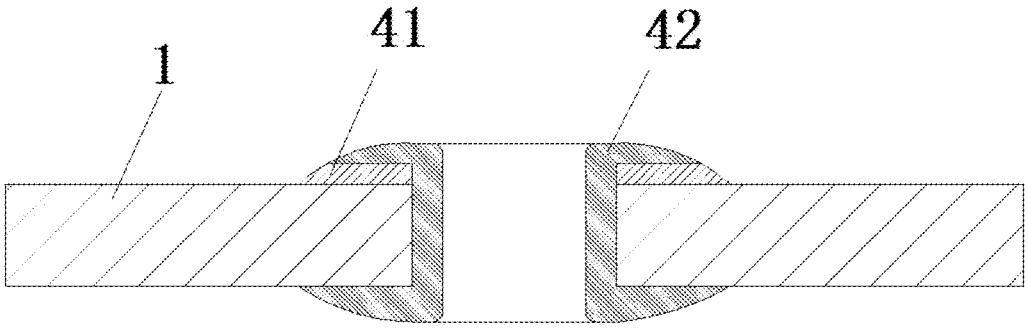
FIG. 12 is simple schematic diagram of section of connection between the buttonhole and the tent cloths after it is fixed in the invention.

As preferred embodiment, shown as FIGS. 11-12, the buttonhole 4 is composed of circle ring 41 and pressed ring 42, the cross section of the buttonhole 4 is circular ring structure in H-shape, and the buttonhole 4 is fixedly connected at folded portion of the tent cloths. The buttonhole 4 in H-shape is providing connection hole for cloth rope 3, the circle ring 41 is pressed by the pressed ring 42 after its upper end is folded, so that the cloth could be pressed tightly by upper and lower ends of the buttonhole 4, which enhances strength of the connection. Further, the amount of the buttonhole 4 could be several and satisfy kinds of connection increasing use adaptation of the tent.

As preferred embodiment, shown as FIGS. 6-10, tent frame 1 is composed of several supporting rods; the supporting rods could be bended and extruded to be installed. The supporting rods could be chosen from square tube, circle tube, 0-typed tube. Further, the supporting rods are fixedly connected by bolts or in an insertion manner. As an embodiment, when the supporting rods are fixedly connected by bolts, nut is in butterfly-shape, bolt is carriage bolt. The nuts in butterfly-shape and carriage bolts are used together, when they are installed, they could be installed by hand without wrench, and it is convenient. As further preferred, shown as FIG. 6, the supporting rods are provided concave structure at bolts connection portion, ensuring head end of bolts enter into the concave slots, so that the bolts would not be convex preventing the tent cloths to be scratched by convex connection element, and meanwhile, the carriage bolts is circle, providing further insurance to prevent the cloths to be scratched. Shown as FIGS. 7-8, the supporting rods could be pressed into flat shape, on the one hand, it solves the problem that the supporting tube would be corroded because water is easy to enter into inner of the supporting rod at end opening, and on the other hand, it reduces the space occupied by the connection.

Figure 9:
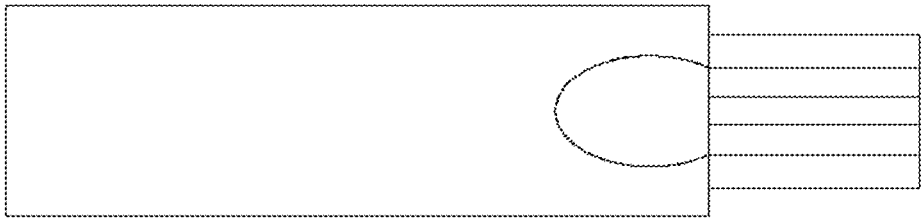
FIG. 9 is simple schematic diagram of structure of insertion end in third connection type of the frame in the invention.
Figure 10:
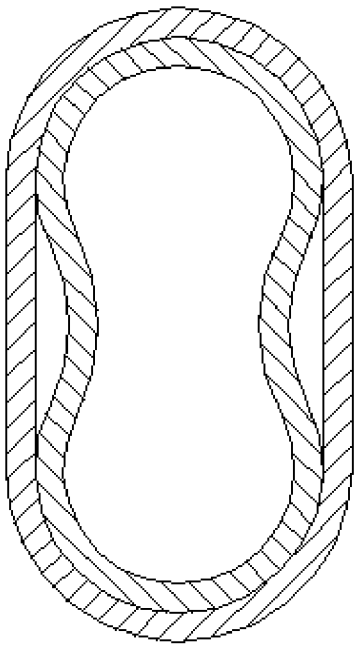
FIG. 10 is simple schematic diagram of section of third connection type in the invention.

As another preferred embodiment, shown as FIGS. 9-10, when the supporting rods are fixedly connected in an insertion manner, cross section of insertion end of the supporting rod is in 8-shape. Structure in 8-shape is inserted into receiving end in 0-shape, on one hand ensuring insertion stable, on the other hand when the insertion is released, gap is remain at edge of 8-shape, making air be easy to enter without negative pressure and easy to be released, the insertion and release is easy. As embodiment in the invention, the supporting rods are connected in an insertion manner, and the insertion end and receiving end of the supporting rods could be chosen from square tube, circle tube, ellipse tube.

As preferred embodiment, the left and right ends of the top cloth 11 are fixedly connected with the left side cloth 12 and right side cloth 13 respectively, back end of the top cloth is connected with the back cloth, and top end of the front cloth is glidingly connected with the frame. In order to make user convenient to enter in and out, top end of the front cloth is glidingly connected with the frame, front cloth could be opened or closed by pulling cloths, and the front cloth also could be provided with stake rope for ting up front cloth pulled to one side to prevent the front cloth blown by wind.

As preferred embodiment, one window is set on the left side cloth 12 and/or the right side cloth 13, and openable curtain is provided on the window. Preferred, several windows could be provided for observing and communicating, and the curtain also could be pulled down to prevent mosquito entering.

Figure 13:
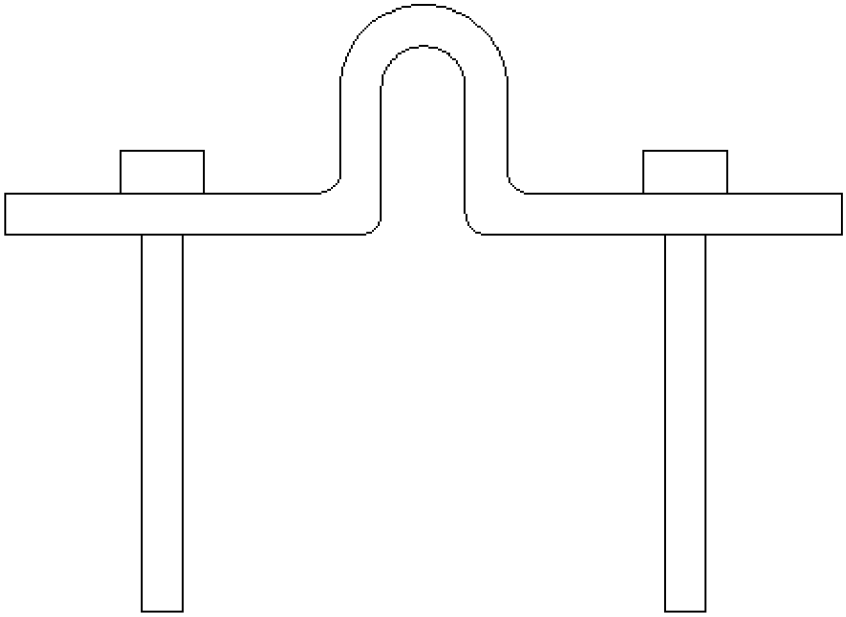
FIG. 13 is simple schematic diagram of one preferred embodiment of fixing to the ground in the invention.
Figure 14:
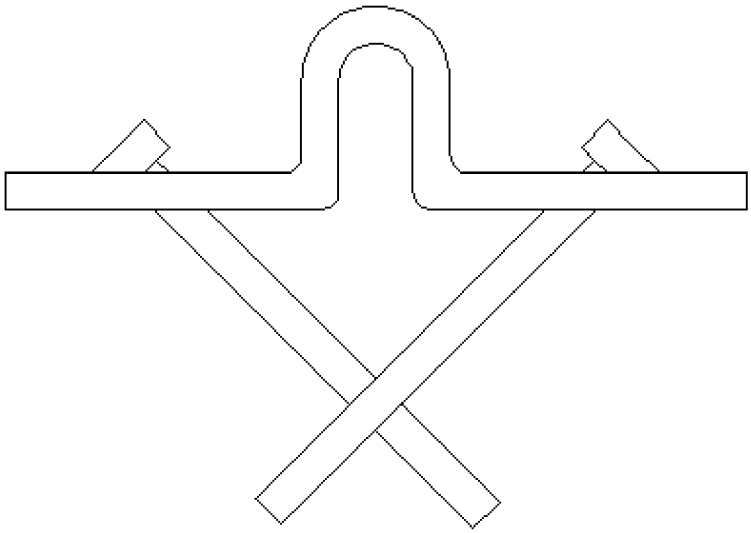
FIG. 14 is simple schematic diagram of another preferred embodiment of fixing to the ground in the invention.

As preferred embodiment, in order to fix the tent onto ground, the tent also includes device for fixing the tent onto ground, shown as FIGS. 13-14, including one mounting bar in Ω-shape and two spikes in T-shape, hollow part of the mounting bar in Ω-shape is mounted on the supporting rod near the ground in the frame, and the spikes in T-shape goes across the left and right ends of the mounting bar in Ω-shape to be inserted into the ground to install and fix the tent. FIG. 13 shows vertical insertion, and FIG. 14 shows cross-insertion.

The working principle of the invention is:

the supporting rods are fixedly connected by bolts or in an insertion manner, forming tent frame 2. Tent cloths is set on the frame and fixed on the frame 2, cloth rope 4 goes through buttonhole 3 to connect top of left side cloth 12 and right side cloth 13. When ventilation is required, tightening the cloth rope 4, left side cloth 12 and right side cloth 13 go near and meanwhile away from left and right ends of top cloth 11 to form ventilation gap making wind flow out. Meanwhile, because left and right ends of top cloth 11 cover top of the left side cloth 12 and the right side cloth 13, respectively, so that when the tent is used in rainy weather, water is not easy to flow into the ventilation gap.

In the invention, the cloth rope is used to connect the left side cloth and right cloth, when there is no wind, the cloth rope is released, when there is wind, the cloth rope is tightened to make top of the left and fight side cloth go near forming ventilation gap between the top cloth and left and fight side cloth. The tent has good ventilation effect, and its structure is simple and easy to be realized.

In the invention, left and right ends of the top cloth cover top of the left side cloth and the right side cloth, therefore, when the tent is used in rain and snow, water would slide to the left and right side cloth from the top cloth, finally water drops onto ground, which solves problem of water entering into the tent at the vent.

In the invention, front end of front cloth is glidingly connected with the frame, so that the front cloth could slide left and right easily, and it is convenient to enter in or out.

In the invention, supporting rod is provided with concave structure at connection portion with bolts, it is convenient to make the bolts enter into the concave slots, so that the bolts would not be convex preventing the tent cloths to be scratched by convex connection element.

In the invention, new nut in butterfly-shape is used, so that when the tent is installed, operator could tight the bolts by hand, and it is convenient.

The above description shows and describes the preferred embodiments in the invention. As mentioned above, it should be understood that the invention is not limited to the disclosed herein, and other embodiments should not be excluded, and the invention could be used in various combinations, modifications, and environments. Within the scope of the inventive concept described herein, the invention could be modified by person skilled in the art can be used for with the above teachings or techniques or knowledge in related fields. Without departing from the spirit and scope of the present invention, changes and variety made by those skilled in the art should be considered in the scope of protection of the appended claims of the present invention.

What is claimed is:

1. A ventilated tent comprising a tent cloth, a tent frame, a cloth rope and a buttonhole; wherein the tent cloth is set on the tent frame fixedly connected to the tent frame; the tent cloth comprises a top cloth, a front cloth, a back cloth, a left side cloth and a right side cloth; a left end of the top cloth covers a top end of the left side cloth, and a right end of the top cloth covers a top end of the right side cloth;

the buttonhole is fixed at an edge of the tent cloth, the cloth rope connects the top end of the left side cloth and the top of the right side cloth through the buttonhole, and a ventilation gap is formed by tightening and relaxing the cloth rope when the top end of the left side cloth goes away from the left end of the top cloth and the top end of the right side cloth goes away from the right end of the top cloth.

2. The ventilated tent according to claim 1, wherein, an edge of each cloth of the top cloth, the front cloth, the back cloth, the left side cloth and the right side cloth is folded, and a folded thickness of the edge of the each cloth is equal to or more than a folded thickness of two tent cloths.

3. The ventilated tent according to claim 2, wherein, the buttonhole comprises a circle ring and a pressed ring, a cross section of the buttonhole is circular ring structure in H-shape, and the buttonhole is fixedly connected at a folded portion of the tent cloth.

4. The ventilated tent according to claim 1, wherein, the tent frame comprises a plurality of supporting rods fixedly connected to each other, and the plurality of supporting rods are bended and extruded to be installed.

5. The ventilated tent according to claim 4, wherein, the plurality of supporting rods are fixedly connected by bolts or in an insertion manner.

6. The ventilated tent according to claim 5, wherein, when the plurality of supporting rods are fixedly connected by the bolts, a nut is butterfly-shaped, each bolt of the bolts is a carriage bolt, and each supporting rod of the plurality of supporting rods is provided concave structure at a connection portion between the bolts.

7. The ventilated tent according to claim 4, wherein, when the plurality of supporting rods are fixedly connected in an insertion manner, a cross section of an insertion end of the plurality of supporting rods is 8-shaped.

8. The ventilated tent according to claim 1, further comprising a device for fixing the ventilated tent onto a ground, the device for fixing the ventilated tent onto the ground comprises one mounting bar in Ω-shape and two spikes in T-shape; a hollow part of the mounting bar in Ω-shape is mounted on a supporting rod next to the ground of the plurality of supporting rods in the tent frame, and the two spikes in T-shape respectively go across left and right ends of the mounting bar in Ω-shape to be inserted into the ground to install and fix the ventilated tent.

9. The ventilated tent according to claim 1, wherein, the left end of the top cloth is fixedly connected to the left side cloth, the right end of the top cloth is fixedly connected to the right side cloth, a back end of the top cloth is connected to the back cloth, and a top end of the front cloth is glidingly connected to the tent frame.

10. The ventilated tent according to claim 1, wherein, one window is set on the left side cloth or the right side cloth, or on both the left side cloth and the right side cloth; and an openable curtain is provided on the window.

* * * * *